US005282180A

United States Patent [19]

Burke et al.

[11] Patent Number: 5,282,180

[45] Date of Patent: Jan. 25, 1994

[54] IMPULSE CLOCK SYSTEM

[75] Inventors: Michael P. Burke, Dearborn; Stephen A. Bogdan, Huntington Woods; Bruce D. Emaus, Dearborn Heights, all of Mich.

[73] Assignee: National Time & Signal Corporation, Oak Park, Mich.

[21] Appl. No.: 589,174

[22] Filed: Sep. 27, 1990

[51] Int. Cl.[5] ..... G04C 11/02; G04C 13/00

[52] U.S. Cl. ..... 368/46; 368/52; 368/59

[58] Field of Search ..... 368/46-61, 368/185-187

[56] References Cited

U.S. PATENT DOCUMENTS

| | | | |
|---|---|---|---|
| 3,011,078 | 11/1961 | Reynolds, Jr. | 368/46 |
| 3,137,121 | 6/1964 | Tringali | 368/52 |
| 3,685,278 | 8/1972 | Haydon | 368/46 |
| 3,739,568 | 6/1973 | Van Haaften | 368/58 |
| 3,889,461 | 6/1975 | Marti et al. | 368/48 |
| 3,902,311 | 9/1975 | Chacon et al. | 368/48 |
| 4,645,357 | 2/1987 | Allgaier et al. | 368/187 |

*Primary Examiner*—Vit W. Miska
*Attorney, Agent, or Firm*—Krass & Young

[57] ABSTRACT

A master/secondary clock system of the impulse type consisting of stepper motor driven secondary clocks and a master control unit. At five minutes before a predetermined registration time, for example 6:00, the sensor of each secondary clock movement is activated by a reverse polarity signal from the master control unit and a series of reset pulses are thereafter transmitted to the secondary clocks with each secondary clock stopping as the window in its drive train gear moves into alignment with the emitter and detector of its sensor mechanism. After this five minute pulse reset phase to correct clocks that are five or less minutes fast, the master control unit transmits a rapid pulse train so as to quickly move all of the remaining clocks to the 6:00 position with each clock being halted at the 6:00 position by movement of the window of its gear into alignment with the emitter and detector of the sensor mechanism of that clock. Following the rapid pulse phase to bring all of the clocks into the correct time mode, normal one minute pulsing of the clocks is resumed by the master control unit.

30 Claims, 3 Drawing Sheets

IMPULSE CLOCK SYSTEM

BACKGROUND OF THE INVENTION

This invention relates to clock systems and more particularly to analog clock systems of the type including a master clock or control and a plurality of secondary clocks controlled by the master. Master and slave systems of the analog type were originally impulse type systems in which the secondary clocks were slaves to the master control unit in the sense that they received pulses from the master every minute or other time increment to advance in normal operation. These systems were of pneumatic design including a pressure bellows and interconnecting pneumatic tubing with air pulses being employed to advance the secondary clocks. While these pneumatic type impulse clocks were generally satisfactory, they required considerable maintenance primarily relating to servicing leaks in the system.

In an effort to avoid these maintenance problems, impulse type systems were developed utilizing electric solenoid driven rachet mechanisms. These solenoid systems improve the reliability of the clock systems but have the disadvantage that they are correctable only to the hour so that if the secondary clocks become scattered throughout the system, they have to be manually reset to the proper hour. Solenoid systems with their ratchet mechanisms are also relatively slow and, for example, cannot exceed a pulse rate greater than 60 per minute without risking mechanical failure.

In an effort to overcome the disadvantages of the solenoid type impulse systems, synchronous motor systems were developed in which each secondary clock includes its own synchronous motor driving the clock mechanism so that the secondary clocks operate independently of the master clock and the master clock functions only to provide correction pulses in the event of a power outage or a mechanical failure. These synchronous systems have the advantage that they make available a sweep second hand frequently utilized by the educational market and they make possible the individual correction of secondary clocks more than one hour out of time. However, these synchronous systems, because they require each of the synchronous motors driving the individual synchronous clocks to run continuously, consume a rather large amount of power. They are also relatively complicated in terms of mechanical design, their speed of reset is rather slow, and they are unable to move directly to the correct hour and minute during correction.

SUMMARY OF THE INVENTION

This invention is directed at the provision of a improved resettable impulse clock system.

More specifically, this invention is directed to the provision of an impulse clock system which is extremely simply in construction and operation and extremely durable.

This invention is further directed to the provision of an impulse clock system which provides ready and rapid resetting of the secondary clocks.

The clock system of the invention includes a plurality of secondary clocks each including an incremental motor device operative to incrementally advance the clock in response to timed pulses and sensor means having active and inactive conditions and operative when activated to stop the clock at a predetermined registration time; and a master control means including a transmitter means operative to transmit real time pulses to the motor devices of the secondary clocks so as to incrementally energize the motor devices and thereby incrementally advance the secondary clocks through real time increments, and conditioning means operative to generate a conditioning signal for activating the sensor means so that any secondary clock thereafter arriving at the predetermined registration time is stopped at the predetermined registration time. This arrangement provides a simple and effective means of normally advancing the secondary clocks through real time increments and for readily resetting the secondary clocks at the predetermined registration time.

According to a further feature of the invention, the master control means is operative to generate the conditioning signal at a predetermined reset time prior to the predetermined registration time so that each secondary clock thereafter arriving at the predetermined registration time is stopped at the predetermined registration time.

According to a further feature of the invention, the master control means is further operative at the predetermined registration time, and with the sensor means still activated, to transmit a plurality of rapid time pulses sufficient in number to move all secondary clocks not already at the predetermined registration time forwardly to the predetermined registration time.

According to a further feature of the invention, each secondary clock includes an hour hand having an axis of rotation, and each sensor means includes indicia means moving along a circular path in synchronism with the movement of the hour hand about its axis, so that the indicia means completes one circular path every 12 hours, and detecting means sensing the angular position of the indicia means along its path. This arrangement provides a simple and effective means of constantly tracking the angular position of the hour hand of each secondary clock.

According to a further feature of the invention, the predetermined reset time is immediately prior to the predetermined registration time. In the disclosed embodiment of the invention, the predetermined registration time corresponds to a precise hour and the predetermined reset time corresponds to a time five minutes prior to the precise hour.

According to a further feature of the invention, the incremental motor drive means of each secondary clock comprises a stepper motor; each secondary clock includes hour and minute hands and a drive train including at least one gear motor interconnecting the stepper motor and the hands; and the indicia means comprise means on the gear member. This arrangement provides a simple and effective means of tracking the angular position of the hands of each secondary clock. In the disclosed embodiment, the gear drives the hour hand directly and rotates about the axis of rotation of the hour hand so as to provide a precise correlation between the movement of the indicia means and the movement of the hour hand.

According to a further feature of the invention, the transmitting means includes means operative to transmit a signal to the incremental motor devices at a first polarity and the conditioning means includes means operative to change the polarity to a second reverse polarity so as to provide a reverse polarity signal. This arrangement provides a simple and effective means for conditioning the sensor means.

According to a further feature of the invention, the sensor means includes an emitter and a detector and the detector is activated by the reverse polarity signal. This arrangement provides a simple and effective means of providing a non-contact, durable sensor means for the secondary clock.

According to a further feature of the invention, the emitter and detector are positioned on opposite sides of the path of the drive train gear member carrying the indicia means. This arrangement provides a compact and simple means of tracking the movement of the hands of the clock. In the disclosed embodiment of the invention, the indicia means is provided by a window in the gear member at a location spaced from the axis of rotation of the gear member and arranged to move periodically between the emitter and detector so as to, with the sensor means activated, provide a signal indicative of the angular position of the hands of the clock.

According to a further feature of the invention, the system includes means operative in response to a sensed disparity between the master time as determined by the master clock unit and the time displayed by at least some of the secondary clocks to advance all of the out of time secondary clocks in a continuous rotation of the hands of the out of time secondary clocks to the master time. This arrangement provides a simple, effective and rapid means of restoring the secondary clocks to their correct time in the event of a disparity between the master time as kept by the master clock unit and the time displayed by the secondary clocks.

According to a further feature of the invention, the master control means is connected to a power supply and is operative to transmit real time pulses to the secondary clock in so long as power is being received from the power supply; operates to record the time duration of any power outage; and, upon restoration of power, operates to transmit a series of rapid pulses to the secondary clocks sufficient in number to move the secondary clocks through a distance corresponding to the time duration of the power outage so as to thereby restore the secondary clocks to correct time. This arrangement provides a simple, effective and rapid means of restoring the secondary clocks to their correct time in the event of a power outage.

According to a further feature of the invention, the master control means includes a master clock connected to the power supply and operative to transmit the real time and rapid pulses, and means for supplying back-up power to the master clock to enable the clock to record the time duration of any power outage. In the disclosed embodiment of the invention, the back-up power means discloses a backup battery connected to the master clock and forming a part of the master control means.

According to a further feature of the invention, the master control means is further operative upon any change in the time being kept by the master control means from an initial time to a new time, to calculate the difference between the initial time and the new time and transmit a series of rapid pulses to the secondary clocks sufficient in number to move the secondary clocks through a time distance corresponding to the time change at the master control unit. This arrangement ensures that the secondary clocks will automatically be corrected in response to any correction of the time being kept at the master clock.

The invention also provides an improved method of maintaining a plurality of impulse movement secondary clocks in synchronism with a master clock unit. The invention method includes the steps of normally maintaining the secondary clocks in timed relation to the mater clock unit by transmitting a series of real time pulses from the master clock unit to the secondary clock; beginning at a predetermined reset time prior to a predetermined registration time an continuing to the predetermined registration time, stopping each secondary clock as it reaches the registration time; immediately after the registration time, transmitting a rapid train of fast forward pulses to the secondary clocks to move the remaining secondary clocks not already stopped at the registration time to the registration time; and stopping each of said remaining secondary clocks at the registration time. This methodology allows all of the secondary clocks to be quickly and effectively reset to the correct time with a minimum of resetting or correcting movement of the secondary clocks.

According to a further feature of the invention methodology, the invention method includes the further steps of providing a sensor in each secondary clock operative when activated to stop the secondary clock at the registration time; maintaining the secondary clock sensors in an inactive condition during the normal pulsing of the secondary clock; activating the secondary clock sensors at the reset time; and deactivating the secondary clock sensors at the conclusion of the transmission of the rapid train of fast forward pulses. This methodology provides a convenient manner of ensuring that the secondary clocks are all stopped at the predetermined registration time.

The invention also provides an improved analog clock mechanism. The analog clock of the invention includes a frame structure; a motor carried by the frame structure; hands mounted for rotary movement on the frame structure; a drive train carried by the frame structure, connecting the motor to the hands of the clock, and including a rotary member moving in synchronism with the hands; indicia on the rotating member; and sensor means carried by the frame, having an activated and an inactivated condition, and operative in its activated condition to track the angular position of the indicia and thereby track the position of the hands. This arrangement provides a simple and effective mean of tracking the position of the hands of the clock mechanism.

According to a further feature of the invention clock mechanism, the sensor means includes an emitter and a detector positioned on opposite sides of the path of the rotary member and the indicia comprises a window in the rotary member movable into a position between the emitter and the detector to allow the detector to receive the emissions from the emitter. In the disclosed embodiment of the invention, the motor is a stepper motor; the rotary member is a gear in the drive train; the clock includes an hour hand and a minute hand; and the gear is connected directly to the hour hand. This specific arrangement provides a simple, compact and efficient package for driving the hands of the clock and for tracking the angular position of the hands of the clock.

DETAILED DESCRIPTION OF THE PREFERRED EMBODIMENT

Figure 1:
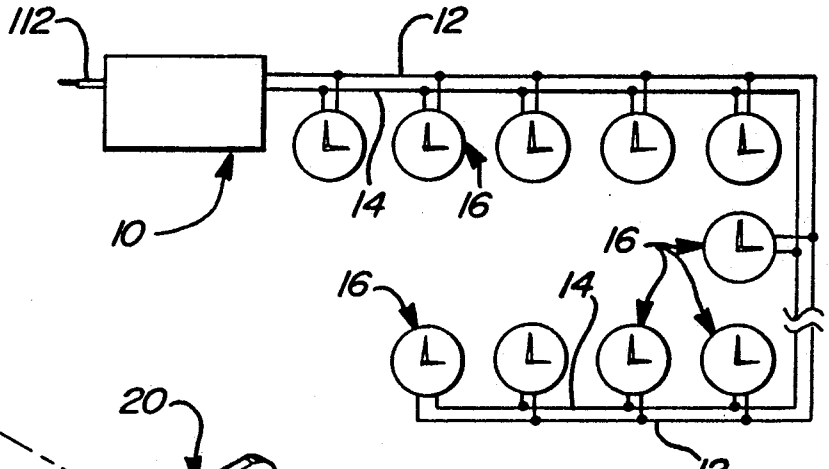
FIG. 1 is a diagrammatic view of a master and secondary clock system according to the invention.
Figure 2:
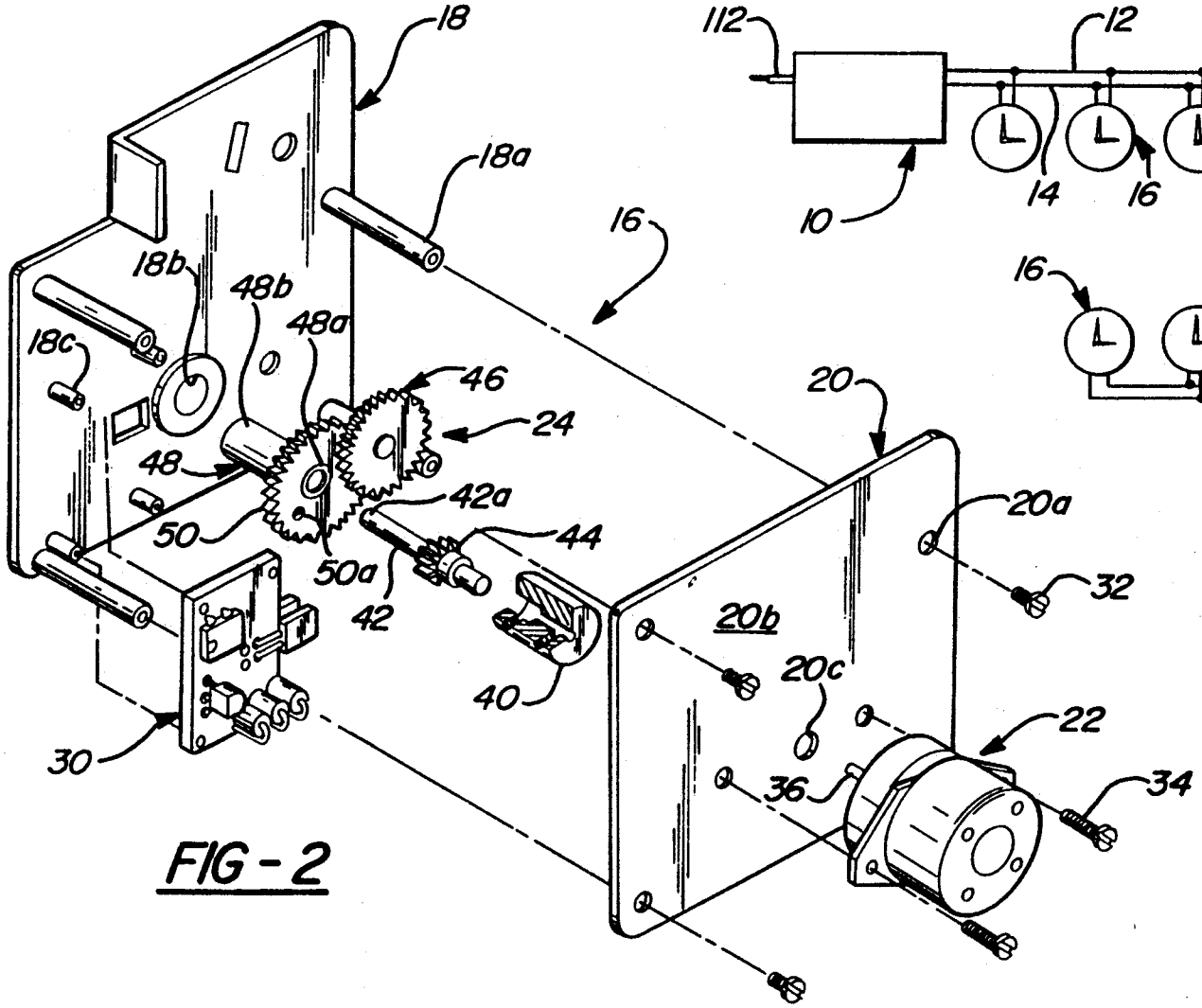
FIG. 2 is an exploded perspective view of one of the secondary clocks employed in the clock system of FIG. 1.
Figure 3:
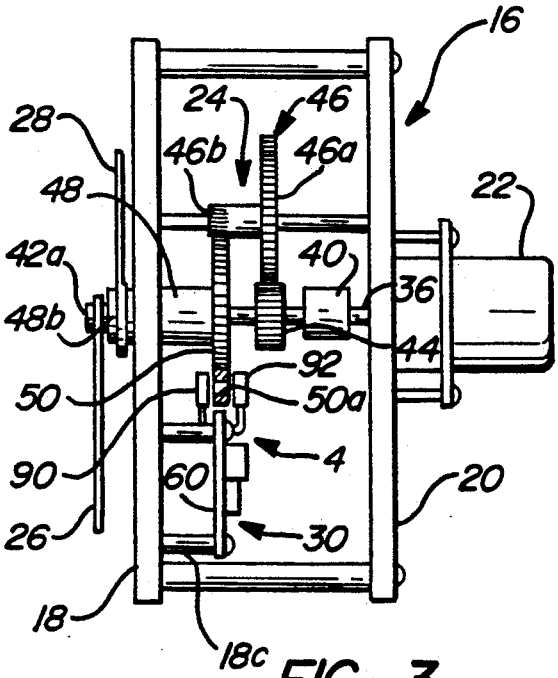
FIG. 3 is a top view of the secondary clock of FIG. 2.
Figure 4:
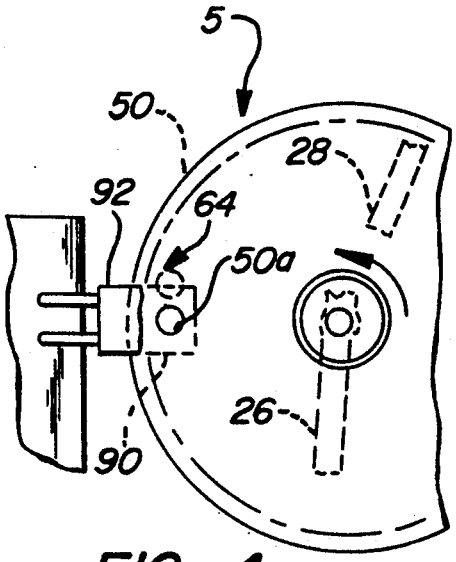
FIG. 4 is a detailed view looking in the direction of the arrow 4 in FIG. 3.
Figure 5:
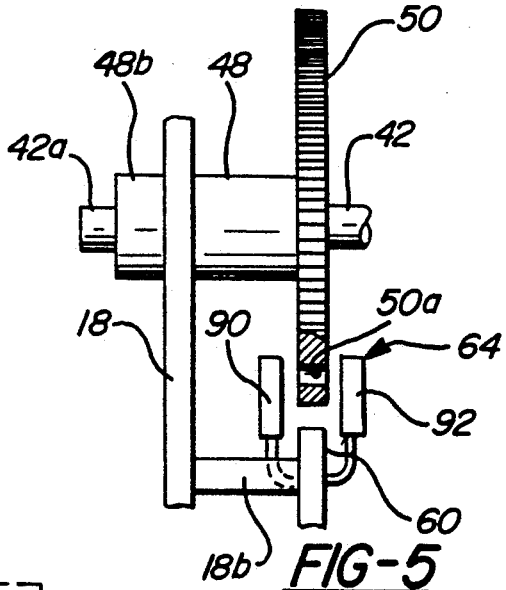
FIG. 5 is a detailed view looking in the direction of the arrow 5 in FIG. 4.
Figure 8:
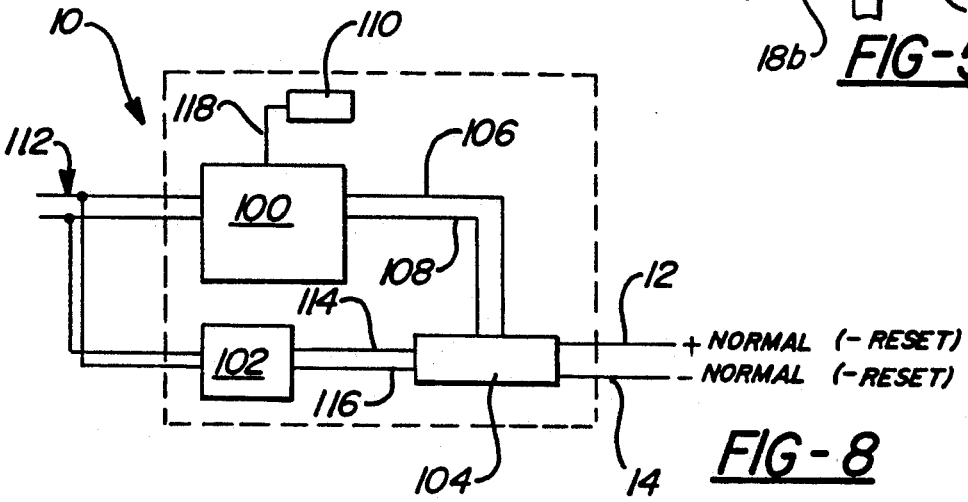
FIG. 8 is a diagrammatic view of the master control unit of the invention clock system.
Figure 6:
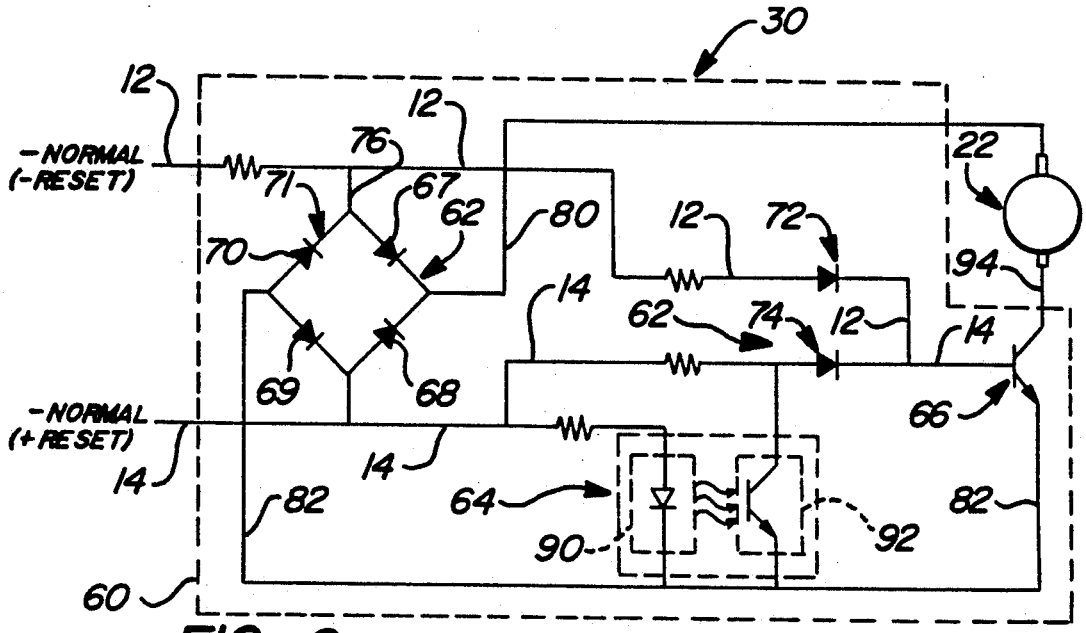
FIG. 6 is a circuit diagram of a motor control assembly employed in each secondary clock.
Figure 7:
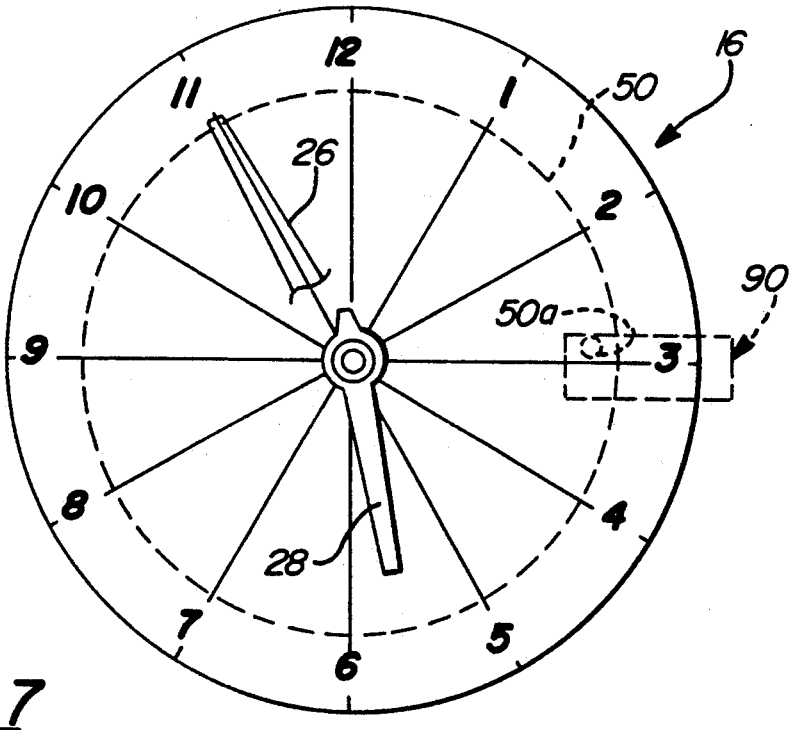
FIG. 7 is a view of the face of a secondary clock.

The invention clock system as seen in FIG. 1 includes a master control unit 10, electrical wires or leads 12 and 14, and a plurality of secondary clocks 16 respectively connected in parallel to leads 12 and 14.

Each secondary clock 16 includes a base plate 18, a back plate 20, a motor 22, a drive train 24, a minute hand 26, an hour hand 28, and a motor control assembly 30.

Plates 18 and 20 are maintained in spaced relation by a plurality of spacers 18*a* carried by base plate 18 and including internally threaded end portions coacting with screws 32 passing through apertures 20*a* in back plate 20 for engagement with the threaded end portions of the spacers 18*a*.

Motor 22 is a single phrase stepper motor and is mounted to the rear face 20*b* of back plate 20 by screws 34 with the output shaft 3 of the motor passing through an aperture 20*c* in the back plate 20. Motor 22 is preferably a 24 VDC, 2 wire, six degrees stepper motor of the type available for example from Haydon Switch and Instrument Inc. of Waterburg Conn. as Part No. A31306.

Drive train 24 includes a union 40 coupled at one end thereof to the free end of motor output shaft 36; a minute hand shaft 42 coupled at one end thereof to the other end of union 40; a spur gear 44 mounted on shaft 42; an intermediate gear 46 including a large diameter portion 46*a* meshing with spur gear 44 and a reduced diameter portion 46*b*; a tubular hour hand shaft 48 journaled in an aperture 18*b* in base plate 18 and centrally passing and journaling minute hand shaft 42; and a gear 50 mounted on the rear end 48*a* of shaft 48 and meshing with reduced diameter gear portion 46*b* of intermediate gear 46.

Minute hand 26 is suitably secured to the distal or free end 42*a* of shaft 42 and hour hand 28 is suitably secured to the free or distal end 48*b* of tubular shaft 48. Drive train 24 will be seen to place the minute hand 26 in direct one to one driving relation to the output shaft 36 of the motor and to place the hour hand 28 in a 12 to 1 ratio with respect to the output shaft of the motor so that the minute hand, in known clock fashion, moves at a rate 12 times the rate of the hour hand.

Motor control assembly 30 includes a printed circuit board 60, a polarity sensitive diode network 62, a sensor assembly 64, and a transistor 66.

Circuit board 60 is of known form and may be positioned, for example, between back plate 20 and base plate 18 by a series of spacers 18*c* carried by base plate 18.

Polarity sensitive diode network 62 includes four diodes 67, 68, 69, 70 arranged in a bridge 71, a diode 72 in line 12, and a diode 74 in line 14. A lead 76 connects lead 12 to bridge 71; a lead 78 connects bridge 71 to lead 14; a lead 80 connects bridge 71 to the positive terminal of motor 22; and a lead 82 connects bridge 71 to transistor 66.

Sensor assembly 64 includes an emitter 90 and a detector transistor 92. Emitter 90 and detector 92 are connected in parallel relation between lead 14 and lead 82.

The three electrodes of transistor 66 are connected respectively to lead 14, lead 82, and a lead 94 connected to the negative terminal of motor 22.

With circuit board 60 positioned on spacers 18*c*, emitter 90 and detector 92 are positioned on opposite sides of the peripheral edge portion of gear 50 so that a window or aperture 50*a* in the peripheral edge portion of gear 50 will pass between the emitter 90 and detector 92 once for every revolution of gear 50 or once every 12 hours.

Master control unit 10 includes a master clock 100, a DC power supply 102, a polarity changer 104, a normal control line 106, a reset control line 108, and a battery 110.

Master clock 100 is computer based and is connected to a suitable 120 VAC source 112. The master clock tasks include time keeping, performing all calculations necessary to incrementally advance the secondary clocks to the exact time, transmitting all pulses on emitter normal line 106 or reset line 108, and interfacing with the user when programming automatic functions such as daylight savings and automatic actuation of peripheral devices such as bells, horns, chimes, lights, etc.

Dc power supply 102 is also connected to 120 VAC source 112 and serves to convert the 120 VAC source to 24 VDC for delivery over lines 114 and 116 to polarity changer 104.

Polarity changer 104 is connected between lines 114, 116 from DC power supply 102; lines 106, 108 from master clock 110; and leads 12, 14 connected to the secondary clocks.

Battery 110 is a back-up power source and is connected by a lead 118 to master clock 100. Battery 110 is provided in the event of a power failure so that the master clock 100 can keep time without the AC power. Instead of a battery, a receiver tuned to WBV or equivalent might be utilized.

It will be understood that the master control unit is the only time keeping component of the system and controls the time on all of the secondary clocks. The master unit keeps time by counting the cycles of the 120 VAC 60 Hz power supplied by the local power company. The master unit can also be adapted to use a 50 Hz supply. Other methods of time keeping can include receiving WWVB, HBG or similar transmissions, modem connection with Bureau of Standards, or various oscillating crystal configurations. The master unit then transmits direct current pulses of voltages dependent upon the stepper motor selection, in this example 24 VDC. These pulses simultaneously advance each secondary clock in the system one increment.

Specifically, during normal or real time operation, master clock 110 pulses normal line 106 which instructs the polarity changer 104 to send pulses over lines 12,14 with line 12 positive and line 14 negative once each minute for a duration of one second. These normal or real time pulses are received by the respective stepper motors 22 of the secondary clocks 16 and are operative to incrementally advance the respective clocks with half of the incremental advance occurring on the rising edge of the pulse and the remaining half of the incremental advance occurring when the pulse is terminated. As previously noted, the pulses are 24 VDC and the motor steps six degrees during each incremental advance so that each incremental advance moves the minute hand forward one minute.

The clocks are advanced in this fashion until the system approaches one of two predetermined registration times, for example, 6 a.m. and 6 p.m. At a chosen time immediately prior to a registration time, for example 5:55, the master clock pulses the reset line 106 instead of the normal line 108 to make line 14 positive and line 12 negative. This reverse polarity pulse has the effect of enabling or activating the sensor assembly 64 in each secondary clock and, specifically, the reverse polarity pulse will turn on the detector transistor 92 and in turn turn off the transistor 66, and thereby the motor 22, at such time as the activated or energized detector transistor 92 receives an emission signal from emitter 90. The master clock thereafter proceeds to transmit reset or reverse polarity pulses to the secondary clocks at one minute intervals until the predetermined registration time of 6:00. This has the effect of correcting the time of any secondary clocks that are running 5 or less minutes fast as compared to the master time as kept by the master clock.

Specifically, if a secondary clock is running 5 minutes fast at the time that the reset pulses begin, the window 50*a* of the gear 50 of that clock will already be positioned between the emitter and detector of the sensor assembly of that clock at the time that the first reset pulse is transmitted by the master clock so that the transistor 66 of that clock will be immediately turned off to halt any further forward movement of that clock. For a clock running four minutes fast as compared to the time of the master clock at the time that the reset or reverse polarity signals are initiated, this clock will respond to the first reset pulse and move forwardly through a one minute increment but will not respond to any of the subsequent reset pulses since the first increment of reset movement will move the window 50*a* of the gear 50 of that clock into alignment with the associated emitter 90 and detector 92 to turn off transistor 66 and thereby motor 22. For a clock running three minutes fast at reset time, this clock will respond to the first two reset pulses transmitted by the master clock but will not respond to any subsequent pulses since the second pulse will have the effect of moving the window 50*a* of its gear 50 into alignment with its emitter 90 and detector 92. A clock running two minutes fast will be halted after receipt of three reset pulses and a clock running one minute fast will be halted after receipt of four reset pulses.

It will be seen that this five minute reset period has the effect of correcting the time of all clocks running between one and five minutes fast with respect to the time kept by the master clock. When the master clock reaches the registration time of 6:00 o'clock, the master clock sends out a long train of rapid pulses on the reset line. For example, pulses 20 milliseconds long may be transmitted every 40 milliseconds for 28.8 seconds for a total of 720 pulses. This string of pulses will provide enough pulses to correct any scattered secondary clock to 6:00. Clocks which are already on time will not be effected by these rapid pulses. The effect of this long train of rapid pulses will be to correct the time of any clocks that were more than five minutes fast at the time of the initiation of the reset operation as well as clocks that were slow at that time as compared to the time kept by the master clock. The described system has the advantage of moving the vast majority of secondary clocks only a small correction amount since the vast majority of clocks will be only a few minutes fast, and will therefore be corrected in the initial five minute reset phase, or will be only a few minutes slow, and will be quickly corrected by the first few pulses of the rapid string of pulses emitted by the master clock at 6:00. For those few clocks which may be more than five minutes fast and which will therefore not be corrected by the initial five minute reset phase, these clocks will be moved a sufficient amount by the 720 pulses emitted by the master clock at 6:00 so as to bring them to the correct time of 6:00.

The long train of pulses will be completed at exactly 28.8 seconds after 6:00 o'clock. At exactly one minute after 6:00, the master clock will again transmit a real time or normal pulse on line 108 to polarity changer 104 which will result in a normal pulse (12 positive and 14 negative) being transmitted to each secondary clock so that the clocks may resume their real time one minute incremental advances.

It will be appreciated that the motor control assembly 30 functions in two manners. The first function is to stop the clock from advancing past the registration time while in the reset mode. The motor control assembly's second function is to keep the polarity of the dc voltage the same at the motor poles regardless of the polarity sent from the polarity changer. The sensor assembly 64 is only energized when line 14 is positive and line 12 is negative, as is the case during the reset mode. During the normal time keeping mode, the sensor assembly is deenergized and the normal polarity, real time pulses from the master control unit (12 positive and 14 negative) will be sent directly to the motor. Since the sensor assembly is only enabled or activated during reset or reverse polarity mode, the normal time pulses will always be able to advance the motor past the registration time of 6:00 o'clock.

Upon any power interruption, the secondary clocks will stop and display the time of the interruption. The master clock 110, utilizing power from the back-up battery 110, records the time of the last pulse and keeps time itself using internal circuitry since the AC line is unavailable. When power resumes, the master clock calculates the time that has passed since the power interruption and then sends out the number of normal polarity pulses, in quick succession and utilizing normal line 106, required to advance all of the clocks to the exact time. Normal time keeping then resumes. As with the reset mode, these normal polarity pulses will be transmitted as pulses 20 milliseconds long every 40 milliseconds so that, for example, to correct for a one hour outage, 60 pulses lasting a total of 2.4 seconds will be required.

Further, at any point in time during the day, independent of registration times, if there exists a disparity between the displayed time on the master clock and at least one secondary clock, the master clock is able to correct all the secondary clocks to the exact time. This time correcting can be initiated, for example, by user intervention at the master clock such as by depression of a button. Although the time disparity between the master clock and at least one secondary clock is unknown to the master clock, all of the secondary clocks will be synchronized by rapidly advancing all of the secondary clocks to their registration time. This is accomplished by transmitting the conditioning signal to activate the secondary clock sensors along with signals to rapidly advance the secondary clocks. This will cause all of the secondary clocks to advance to the registration time and stop. At this point the master clock will be able to calculate the disparity between the registration time and the time displayed by the master clock and transmit signals to rapidly advance all of the secondary clocks to this time.

Changing or correcting the master time at the master clock at any time also results in the master clock calculating the difference between the initial time and the new or corrected time and then advancing all clocks to the exact minute. These correctional pulses may also be transmitted as pulses 20 milliseconds long every 40 milliseconds so that any correction of the secondary clocks to match the changed time at the master clock may be effected in a matter of seconds.

The invention master and secondary clock system will be seen to provide many important advantages as compared to prior art systems. Specifically, the invention clock system, while preserving the low power consumption feature of an impulse clock system, provides a simple, ready and effective means for correcting the time of the secondary clocks; provides a ready, simple and effective means of automatically correcting the secondary clocks in the event of a power interruption or a change of the time being kept by the master unit; and provides a sensing mechanism which, because of the use of a non-contact arrangement, avoids the contact wear and corrosion problems that have plagued prior art designs.

Although a preferred embodiment of the invention has bee illustrated and described in detail it will be apparent that various changes may be made in the disclosed embodiment without departing from the scope or spirit of the invention. For example, although an impulse clock system has been described in the example given, the same technology and design can be utilized in an attendance recorder, a parking gate, a time stamp, or an elapsed time indicator system with appropriate modification of the drive mechanism. The term clock as used herein refers to any manner of time indicating, controlling, or recording mechanism such as a clock with a dial and hand, a digital clock, a time switch, a repeat cycle timer, an elapsed time indicator, a chart drive, or any other mechanism where the essential function of the mechanism is dependent on timing intelligence.

Further, although the master clock has been described as transmitting real time pulses to the slave clocks, the invention also contemplates the master clock transmitting coded information to the slave clocks for conversion at the slave clocks into real time pulses for transmittal to the stepper motor of the slave clocks.

We claim:

1. A clock system comprising:

a plurality of secondary clocks each including an incremental motor device operative to incrementally advance the clock in response to timed pulses and sensor means having an active and an inactive condition and operative when activated to stop the clock at a predetermined registration time; and control means operative to transmit real time pulses to said motor devices so as to incrementally energize said motor devices and thereby incrementally advance said secondary clocks through real time increments and conditioning means operative to generate a conditioning signal for activating said sensor means so that any secondary clock thereafter arriving at said predetermined registration time is stopped at said predetermined registration time.

2. A clock system according to claim 1 wherein:

said control means is operative to generate said conditioning signal at a predetermined reset time prior to said predetermined registration time so that each secondary clock thereafter arriving at said predetermined registration time is stopped at said predetermined registration time.

3. A clock system according to claim 2 wherein:

said control means is further operative at said predetermined registration time, and with said sensor means still activated, to transmit a plurality of rapid time pulses sufficient in number to move all clocks not already at said predetermined registration time forwardly to said predetermined registration time.

4. A clock system according to claim 1 wherein:

each secondary clock includes an hour hand having an axis of rotation; and each said sensor means includes indicia means moving along a circular path in synchronism with the movement of said hour hand about said axis, so that said indicia means completes one circular path every 12 hours, and detecting means sensing the angular position of said indicia means along said path.

5. A clock system according to claim 4 wherein:

said predetermined registration time corresponds to a precise hour; and said predetermined reset time corresponds to a time immediately prior to said predetermined registration time.

6. A clock system according to claim 5 wherein:

said predetermined registration time and said predetermined reset time are separated by no more than 15 minutes.

7. A clock system according to claim 6 wherein:

said predetermined reset time precedes said predetermined registration time by approximately 5 minutes.

8. A clock system according to claim 4 wherein:

the incremental motor device of each secondary clock comprises a stepper motor;

each secondary clock includes hour and minute hands and a drive train including at least one gear member interconnecting the stepper motor and the hands; and said indicia means comprise means on said gear member.

9. A clock system according to claim 8 wherein:

said gear drives said hour hand and rotates about said axis.

10. A clock system according to claim 1 wherein:

said control means includes transmitter means operative to transmit a signal to said incremental device at a first polarity; and said conditioning means includes means operative to change said polarity to a second reverse polarity so as to provide a reverse polarity signal.

11. A clock system according to claim 10 wherein:

said sensor means includes an emitter and a detector; and said detector is activated by said reverse polarity signal.

12. A clock system according to claim 11 wherein:

said incremental motor device comprises a stepper motor;

each secondary clock includes hour and minute hands and a drive train including at least one rotatable gear member interconnecting said motor and said hands;

said gear member includes indicia means moving in a circular path in response to rotation of said gear member; and said emitter and detector are positioned on opposite sides of the path of said indicia means.

13. A clock system according to claim 12 wherein:

said indicia means comprises a window in said gear member at a location spaced from the axis of rotation of the gear member.

14. A clock system comprising:

a plurality of secondary clocks each including an incremental motor device operative to incrementally advance the clock in response to timed pulses and sensor means having an active and an inactive condition and operative when activated to stop the clock at a predetermined registration time; and control means operative to transmit timed pulses to said incremental motor devices to advance said secondary clocks through real time increments and further operative to transmit a rapid series of pulses to said incremental motor devices to move all of said clocks forwardly at a fast forward speed and further operative to transmit a conditioning signal to said sensor means to activate said sensor means so that all clocks thereafter arriving at said predetermined registration time are stopped at said predetermined registration time.

15. A clock system according to claim 14 wherein:

said control means is further operative, prior to transmitting said rapid series of pulses, to transmit a conditioning signal to said sensing means in combination with a series of real time pulses so as to move all of said secondary clocks forwardly through real time increments and stop each clock thereafter arriving at said predetermined registration time at said predetermined registration time, whereafter, with said conditioning signal still operative, said rapid series of pulses may be transmitted to rapidly advance all secondary clocks not yet at said predetermined registration time t said predetermined registration time.

16. A clock system according to claim 14 wherein:

said control means is operative at a predetermined reset time prior to said predetermined registration time to transmit a conditioning signal to said sensor means in combination with a series of real time pulses corresponding in number to the time differential between said predetermined registration time and said predetermined reset time.

17. A clock system according to claim 2 wherein:

said control means is further operative at said predetermined registration time and with said sensor means still activated, to move all clocks not already at said predetermined registration time forwardly to said predetermined registration time.

18. A clock system according to claim 1 wherein:

said secondary clock includes hour and minute hands having an axis of rotation; and each said sensor means includes an indicia means moving along a circular path in synchronism with the movement of one of said hands about said axis and detecting means sensing the angular position of said indicia means along said path.

19. A clock system according to claim 4 wherein:

said predetermined reset time corresponds to a time immediately prior to said predetermined registration time.

20. A clock system according to claim 10 wherein:

said sensor means includes an emitter element and a detector element; and one of said elements is activated by said reverse polarity signal.

21. An analog clock mechanism comprising:

a frame structure;

a motor carried by said frame structure;

hands mounted for rotary movement on said frame structure;

a drive train carried by said frame structure connecting said motor to said hands and including a rotary member moving in synchronism with said hands;

indicia on said rotary member; and sensor means carried by said frame, having an activated and an inactivated condition, and operative in said activated condition to track the angular position of said indicia and thereby track the position of said hands.

22. A clock according to claim 21 wherein:

said sensor means includes an emitter and a detector positioned on opposite sides of the path of said rotary member.

23. A clock according to claim 22 wherein:

said indicia comprises a window in said rotary member movable into a position between said emitter and said detector to allow said detector to receive the emissions from said emitter.

24. The clock according to claim 23 wherein:

said motor is a stepper motor; and said rotary member is a gear in said drive train.

25. A clock according to claim 24 wherein:

said clock includes an hour hand and a minute hand; and said gear is connected directly to said hour hand.

26. A clock according to claim 24 wherein:

said clock includes an hour hand and a minute hand; and said gear is connected directly to one of said hands.

27. A method of maintaining a plurality of impulse movement secondary clocks in synchronism with a master clock unit comprising the steps of:

normally maintaining the secondary clocks in timed relation to the master clock unit by transmitting a series of real time pulses from the master clock unit to the secondary clocks;

beginning at a predetermined reset time prior to a predetermined registration time and continuing to the predetermined registration time, stopping each secondary clock as it reaches the registration time;

immediately after the registration time, transmitting a rapid train of fast forward pulses to the secondary clocks to move the remaining secondary clocks not already stopped at the registration time to the registration time;

stopping each of said remaining secondary clocks at the registration time;

providing a sensor in each secondary clock operative when activated to stop the secondary clock at the registration time;

maintaining the secondary clock sensors in an inactive condition during the normal pulsing of the secondary clock;

activating the secondary clock sensors at the reset time; and deactivating the secondary clock sensors at the conclusion of the transmission of the rapid train of fast forward pulses.

28. A clock system comprising:

a plurality of secondary clocks each including an incremental motor device operative to incrementally advance the clock in response to time pulses and sensor means having an active and inactive condition and operative when activated to stop the clock at a predetermined registration time; and control means operative to transmit time pulse to said incremental motor devices to advance said secondary clocks through real time increments, further operative to transmit forward signals to said incremental motor devices to move all of said clocks forwardly at a fast forward speed, and further operative to transmit a conditioning signal to said sensor means to activate said sensor means so that all clocks thereafter arriving at said predetermined registration time are stopped at said predetermined registration time.

29. A clock system according to claim 28 wherein:

said control means is further operative prior to transmitting said forward signals to transmit a conditioning signal to said sensing means in combination with said forward signals so as to move all of said secondary clocks forwardly through the real time increments and stop each clock thereafter arriving at said predetermined registration time at said predetermined registration time whereafter with said conditioning signal still operative, said forward signals may be transmitted to rapidly advance all secondary clocks not yet as said predetermined registration time to said predetermined registration time.

30. A method of maintaining a plurality of impulse movement secondary clocks in synchronism with a master clock unit comprising the steps of:

normally maintaining the secondary clocks in timed relation to the master clock unit by transmitting a series of real time pulses from the master clock unit to the secondary clocks;

beginning at a predetermined reset time prior to a predetermined registration time and continuing to the predetermined registration time, stopping each secondary clock as it reaches the registration time;

immediately after the registration time, transmitting forward signals to the secondary clocks to move the remaining secondary clocks not already stopped at the registration time to the registration time;

stopping each of said remaining secondary clocks at the registration time;

providing a sensor in each secondary clock operative when activated to stop the secondary clock at the registration time;

maintaining the secondary clock sensors in an inactive condition during the normal pulsing of the secondary clock;

activating the secondary clock sensors at the reset time; and deactivating the secondary clock sensors at the conclusion of the transmission of the forward signals.

* * * * *